350-96.1 SR
9/3/85 XR 4,538,527

United States Patent [19]

Kitchen

[11] Patent Number: 4,538,527

[45] Date of Patent: Sep. 3, 1985

[54] SECURITY SYSTEM

[75] Inventor: Cedric A. Kitchen, Whitford Holywell, Wales

[73] Assignee: Pilkington P.E. Limited, England

[21] Appl. No.: 421,412

[22] Filed: Sep. 22, 1982

[30] Foreign Application Priority Data

Oct. 9, 1981 [GB] United Kingdom ..... 8130572

[51] Int. Cl.[3] ..... G08B 13/18

[52] U.S. Cl. ..... 109/21; 109/38; 109/58; 52/173 R; 52/221; 340/550; 350/96.1

[58] Field of Search ..... 109/21, 38, 40, 42, 109/58; 116/67 R, 202; 340/550, 815.31; 350/96.1, 215, 221; 52/173, 221

[56] References Cited

U.S. PATENT DOCUMENTS

| | | | |
|---|---|---|---|
| 3,947,837 | 3/1976 | Betterice | 340/550 |
| 4,228,425 | 10/1980 | Cooke | 340/550 |
| 4,234,875 | 11/1980 | Williams | 340/550 |
| 4,367,460 | 1/1983 | Hodara | 340/550 |
| 4,399,430 | 8/1983 | Kitchen | 340/550 |

FOREIGN PATENT DOCUMENTS

| | | | |
|---|---|---|---|
| 197805 | 9/1976 | France | 109/42 |
| 1602743 | 9/1977 | United Kingdom . | |
| 2038060 | 10/1978 | United Kingdom . | |
| 2060966A | 8/1980 | United Kingdom . | |
| 2046971 | 11/1980 | United Kingdom | 340/550 |
| 1602112 | 11/1981 | United Kingdom | 340/550 |

*Primary Examiner*—Hugh R. Chamblee
*Attorney, Agent, or Firm*—F. Eugene Davis, IV

[57] ABSTRACT

A composite security panel having at least two fibre optic elements contained within a block of material, the elements being arranged with portions emerging from the panel at three or more spaced locations. Translatory movement, rotation or tilting of the panel when assembled in a wall or housing causing translatory movement of an emergent portion of an element resulting in the interruption of a transmission line through the wall of housing. The elements may be firmly embedded within the panel, the fibre optic being carried on a strip of mateial, or the elements may be formed into a mesh which can be loosely housed between interconnectable sections of the panels.

18 Claims, 10 Drawing Figures

FIG. 6.
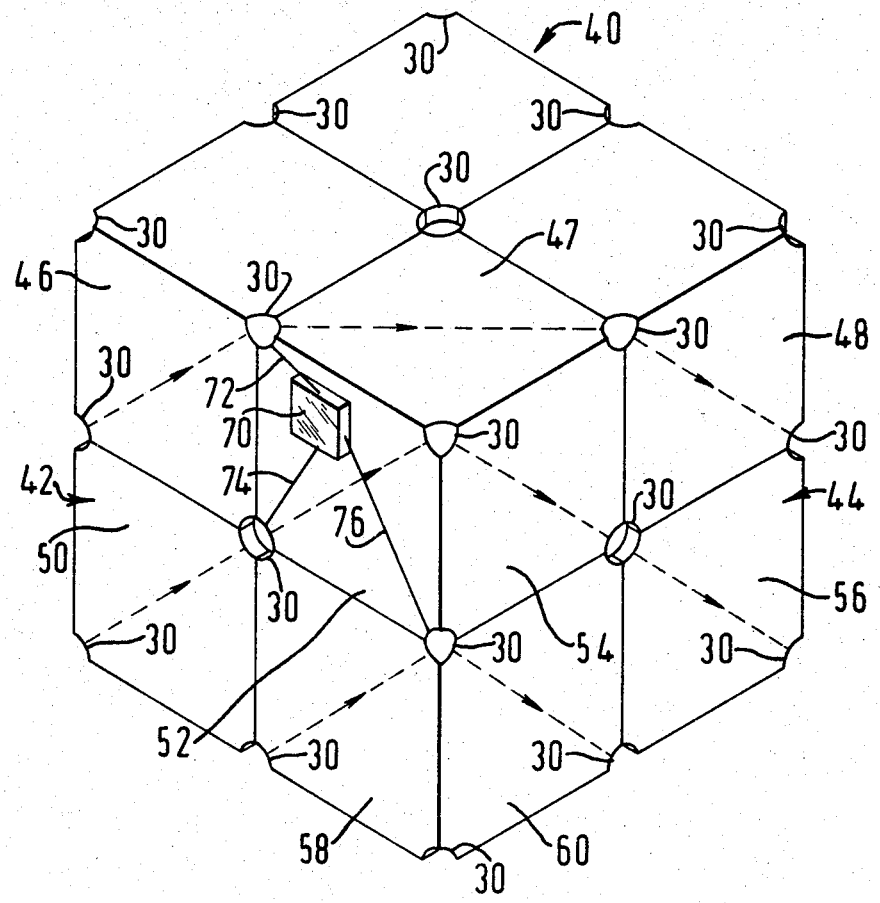
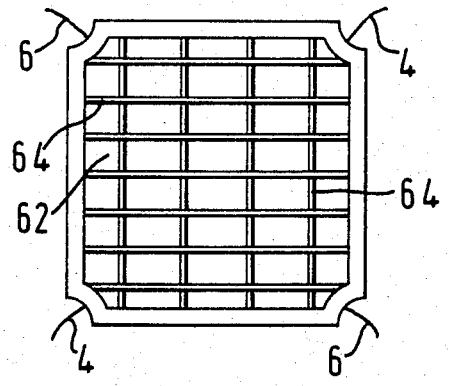
FIG. 7.

SECURITY SYSTEM

FIELD OF THE INVENTION

The invention relates to a security system employing optical fibres for detecting intrusion attempts into a protected area to a composite panel to be used in the security system and to a method of making the composite panel.

BACKGROUND OF THE INVENTION

A number of security systems which make use of fibre optic elements in their construction are known. In South African Pat. No. 78/5419 for example a security system is described in which fibre optic elements are located in a wall along a boundary of an area to be protected. Breakage or damage to one or more of the fibre optic elements, caused for example by an intruder, results in a reduction in the intensity of or complete loss of an optical signal in such fibre optic elements and the detection of this signal intensity reduction or loss signifies an intrusion attempt. In the specification accompanying U.K. Patent Application GB No. 2,038,060A another security system is disclosed, and in that arrangement a wall to be protected has embedded in it a mesh of optical fibres with the fibres arranged in a reticulated pattern. Each fibre has a light source at one end and light detector at the other end. If one or more of the fibres is broken then the cessation of light in such fibres is used to give an alarm.

The above known security systems tend to be both expensive and difficult to install, one needing to take great care that the fibre optical elements are not damaged during the erection of the wall in which they are being embedded. Furthermore should a fault occur in one or more of the fibre optic elements, either during the erection of subsequent to the erection of the wall, then the location of that fault and its repair may be an expensive and difficult procedure involving the destruction of a part or in extreme cases the whole of the wall. Such walls are also built so that they cannot easily be dismantled without damage to the fibre optic elements embedded within the wall. This can be a disadvantage if one wished to dismantle part of the wall to repair a fault or to dismantle the wall completely so as to re-erect it elsewhere as a major portion of the fibre optic elements may need to be replaced as a result of damage caused to them by the part or total dismantling of the wall.

U.K. Patent Application No. 2,060,966A described a security system in which a security wall is built up from a number of composite panels incorporating fibre optic elements in hollow tubes. Several panels are stacked together and mounted between a pair of box posts to define a section of the wall. The fibre optic elements in a panel in one section of the wall are connected via connectors in the box posts to fibre optic elements in a panel in an adjacent section of the wall. One of the disadvantages of this security system and the other known security systems described above is that they provide only a limited degree of security in that an intruder once having carefully removed part of the wall and gained access to the fibre optic elements may then succeed in gently stretching adjacent fibre optic elements apart so as to create a gap sufficient to squeeze through, without there being any rupture of the optic fibre elements. It is possible to stretch fibre optic elements apart in this way because of the elasticity of the fibres some of which can be extended by up to 3% before they rupture.

In the security wall described in U.K. Patent Application No. 2,060,966A an intruder may also attempt to gain access by releasing a panel from the box posts and from its adjacent panel or panels in the same section of the wall, the fibre optic elements within the panel still having their ends connected to the connectors in the box posts. Then in view of the long lengths of fibre optic elements within the hollow tubes those lengths of fibre optic elements may be sufficiently extensible to allow sufficient rotation of that individual panel so as to gain access through the wall.

SUMMARY OF THE INVENTION

One of the objects of the present invention is to strive to overcome the above problems by constructing the security wall from a number of specially designed composite panels.

According to the present invention there is provided a composite panel comprising at least two fibre optic elements contained within a block of material, the elements being arranged with portions emerging from the panel at three or more spaced locations whose relative positions are such that when a plurality of such panels are installed together to form a security wall or housing having a number of transmission lines within the wall or housing, the panels cannot be moved relative to one another by translatory movement, rotation or tilting so as to provide access through the security wall or housing without also causing translatory movement of at least one emergent portion of one of the elements, and means being provided to ensure interruption of a transmission line in the wall or housing as a consequence of the translatory movement of the emergent portion of the element.

In one embodiment the fibre optic elements within the block of material have their ends emerging from the panel at the three or more spaced locations, the ends of the fibre optic elements in one panel being connectable to respective ends of fibre optic elements in another panel so as to form the security wall or housing having transmission lines therethrough, the elements being firmly embedded within the block of material so that the translatory movement of an end of one of the elements leads to rupture of the element and the interruption of one of the transmission lines through the wall or housing. The block of material is conveniently in the form of a polyhedron having at least four faces, and in one embodiment each end of one fibre optic element emerges from the block at a respective one of a pair of faces or corner regions of the block, and one or both ends of a second fibre optic element emerges from the block at another face or corner region or a respective one of another pair of faces or corner regions of the block. In a preferred embodiment the block of material has six faces.

Advantageously at least one of the fibre optic elements follows a circuitous or zig-zag route through the block of material. In a preferred embodiment each of the fibre optic elements is carried on a respective supporting member embedded within the block of material, each of two supporting members following a different circuitous or zig-zag route through the block of material.

In embodiments in which each end of one fibre optic element emerges from the block at a respective one of a pair of faces or corner regions of the block, and each end of a second fibre optic element emerges from the block at a respective one of another pair of faces or corner regions of the block, the faces or corner regions of each pair may be disposed either adjacent or opposite to one another but preferably they are disposed opposite to one another.

In one embodiment the ends of the fibre optic elements emerge at small recesses formed in the faces or at the corner regions of the block.

The composite panels are conveniently manufactured by means of a moulding process using glass fibre reinforced cement or plastics for the block material. In the moulding process the fibre optic elements are laid in the mould in a fixed position, preferably in a zig-zag configuration, and means are provided to retain them in that position whilst the glass fibre reinforced cement or plastics material is poured, sprayed or otherwise introduced into the mould. The material is then allowed to set and the formed composite block removed from the mould.

In the fibre optic elements are not retained in a fixed position within the mould during the moulding process then there is a tendency for portions of the fibre optic elements to become distorted and form kinks at points along the elements. This can create high and deleterious stresses at those points along the length of the fibre optic elements and such stresses may lead to the rupture of the fibre optic element at those points.

The means for retaining the fibre optic elements in a fixed position in the mould is preferably by the provision of supporting members, each fibre optic element being carried on a respective supporting member.

The supporting member for the fibre optic element may conveniently comprise an elongate carrier strip formed with a groove along the centre of one side for receiving the fibre optic element, the fibre optic element being held within the groove by an elongate protective strip overlying the fibre and the groove. Preferably the protective strip is impermeable to fluids which can attack the fibre optic element and conveniently is also flexible so that the pressure of fluids acting on the outside of the protective strip deforms the protective strip into the groove so holding the fibre optic element firmly in place between the protective strip and the carrier strip. Holding the fibre optic elements firmly in place between the protective strip and the carrier strip provides enhanced security as there are no loose portions of the fibre optic elements within the body of the composite panel that can be stretched. The protective strip also protects the fibre optic element from contact with particulate material in the block and smooths out the pressure forces exerted on the element by adjacent particulate material.

It is advantageous to provide barbs or serrations along the edge or edges of the carrier strip as they assist in keying the carrier strip in the material of the block. It is also advantageous to make the width of the carrier strip substantially larger than its thickness, the ratio of the width of the carrier strip to its thickness, hereinafter referred to as the aspect ratio of the carrier strip, being advantageously more than 10 and in a preferred embodiment more than 20. By choosing a sufficiently high aspect ratio for the carrier strips within a composite panel one can ensure that when a force is exerted on the panel such as to fracture the block material, so the carrier strips form kinks at the region of fracture. As the fibre optic element is firmly clamped to the carrier strip so the fibre optic element will bend at the point of the kink with a radius of curvature less than the minimum bend radius allowable if the fibre optic element is to remain intact. Any attempt to penetrate the composite panel which leads to fracture of the panel thereby leads to rupture of a fibre optic element and the generation of an alarm signal.

The block material and the design of the composite panel is chosen for the particular security application for which the panel is to be employed. The composite panels may for example be formed as a completely solid block or have one or more holes through their body enabling fluids or ducting to pass through the panel.

In one embodiment there is provided a wall made from a number of the composite panels being arranged in juxtaposition, each fibre optic element in a panel being connected to a respective fibre optic element in an adjacent panel so as to form a continuous fibre optic line through the wall or housing.

In another embodiment there is provided a security structure consisting of a number of juxtaposed panels having their fibre optic elements connected to respective fibre optic elements in adjacent panels, the panels being arranged so as to partially or completely surround a location to be protected.

A feature of the present invention is the provision of a security system in which at least one composite panel is provided to cover an area to be protected, each composite panel comprising a block of material having firmly embedded therein at least two fibre optic elements, the elements being arranged with their ends emerging from the panel at three or more spaced locations whose relative positions are such that they do not all lie along one straight line, means being provided for directing optical radiation along the fibre optic elements and detector means to detect optical radiation that has passed through the fibre optic elements, the detector means being responsive to a change in detected radiation.

In one embodiment the each composite panel of the security system comprises a block of material in the form of a polyhedron having at least four faces, and embedded in the block are at least two fibre optic elements each of which is carried on a respective supporting member, each end of one fibre optic element emerging from the block at a respective one of a pair of faces or corner regions of the block and one or both of the ends of a second fibre optic element emerging from the block at another face or corner region of a respective one of another pair of faces or corner regions of the block.

The security system can comprise a number of composite panels in juxtaposition so as to cover a larger area or can be arranged in the form of a security structure partially or completely surrounding a location to be protected. In such embodiments each end of the fibre optic elements emerging from one panel is interconnected with a respective end of a fibre optic element emerging from an adjacent juxtaposed panel.

In another embodiment of composite panel the fibre optic elements are assembled together in the form of a mesh-like structure, the structure having a number of jointing points at which portions of the elements are secured by securing means in a position fixed relative to one another, the portion of an element emerging from the block being sufficiently close to a jointing point to ensure that translatory movement of the emergent portion leads to rupture of the element and the interruption of one of the transmission lines through the wall or housing.

In such an embodiment it is convenient to assemble the panels in situ with a continuous length of mesh extending through and between them. In one method of assembly each panel is formed from two interconnectable sections which are manufactured by a moulding process using glass fibre reinforced cement or plastics material. Each or both of the sections may be provided with a mesh-like groove into which the mesh-like structure can be located. When building the panels into a wall or housing first sections from each of the panels are mounted together in line so as to define a length of the wall or housing, the continuous length of mesh is then located into the grooves of the assembled first sections and the remaining second sections of each of the panels are then secured in place over the first sections to enclose the mesh. In this way a number of composite panels are assembled in situ to provide a wall or housing.

The mesh in the composite panels may be firmly or loosely held in place between the sections of the panels.

The mesh used is preferably like the mesh-like intruder detection structures described in European Patent Application No. 0049979.

In one embodiment the present invention provides a security wall or housing made from a number of composite panels arranged in juxtaposition, a mesh-like structure of fibre optic elements extending through the wall or housing to define a number of transmission lines, the mesh-like structure having a number of jointing points at which portions of the elements are secured by securing means in a position fixed relative to one another, the portion of an element extending between two adjacent panels being sufficiently close to a jointing point to ensure that translatory movement of that portion leads to a rupture of the element and the interruption of one of the transmission lines through the wall of housing.

The invention also provides a security system in which the security wall or housing made up from a number of composite panels as described in the preceding paragraph is provided with means for directing optical radiation along the fibre optic elements in the mesh and detector means to detect radiation that has passed through the fibre optic elements, the detector means being responsive to a change in detected radiation.

BRIEF DESCRIPTION OF THE DRAWINGS

The invention will be described further by way of example with reference to and as illustrated in the accompanying drawings in which:

FIG. 6 is a cube shaped security structure built up from composite panels like that if FIG. 1, FIG. 7 is a further embodiment of a composite panel.

DESCRIPTION OF THE PREFERRED EMBODIMENTS

Figure 1:
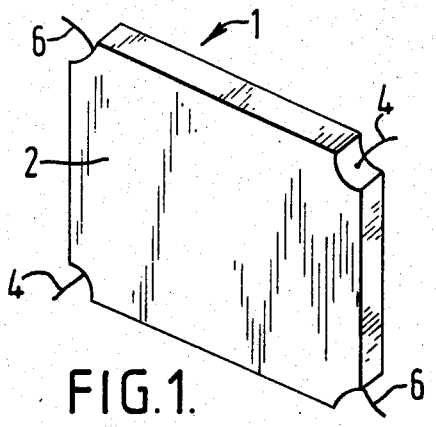
FIG. 1 shows in perspective one embodiment of a composite panel according to the present invention.
Figure 2:
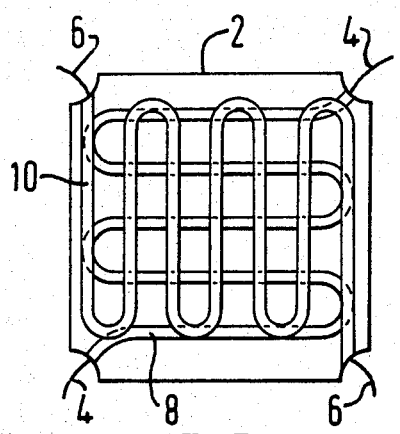
FIG. 2 is a cross-section through the centre of the composite panel in FIG. 1.

Referring to FIGS. 1 and 2 a composite panel 1 comprises a block 2 of glass fibre reinforced cement in which is embedded two fibre optic elements 4,6 in the form of single optical fibres carried on a respective supporting member 8,10. Each of the supporting members 8,10 follow a circuitous route through the block 2 and are arranged so that the ends of each of the fibre optic elements 4,6 emerge from opposite recessed corners of the block 2. The supporting member 10 and its fibre optic element 6 is embedded in the block 2 in a different plane to that of the supporting member 8 and its fibre optic element 4, the two differing zig-zag routes of the supporting members 8,10 together forming a grid-like configuration within the block 2.

Figure 4:
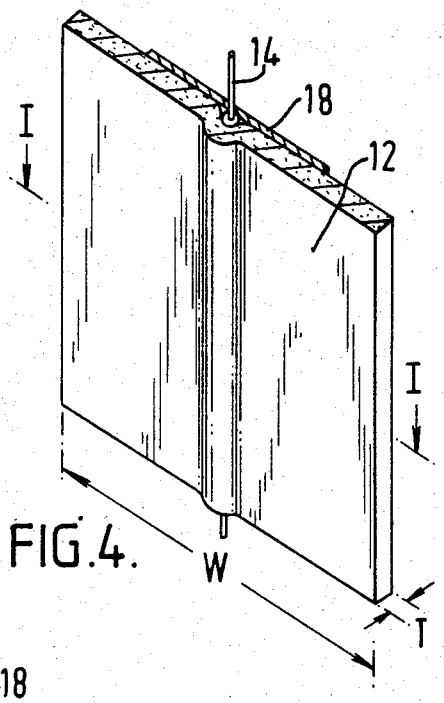
FIG. 4 is one embodiment of a supporting member shown in FIG. 2 carrying the lengths of fibre optic element embedded in the composite panel.
Figure 5:
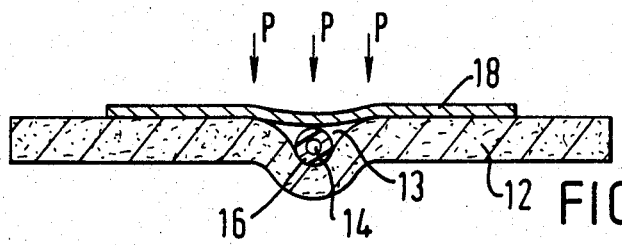
FIG. 5 is a section along the line I—I of FIG. 4.

Referring now to FIGS. 4 and 5 the supporting members 8,10 each comprise an elongate steel carrier strip 2 formed with a groove 13 along the centre of one side for receiving an optical fibre 14, the optical fibre 14 being enclosed with a plastics sheathing 16. The optical fibre 14 and its plastics sheathing 16 are held within the groove 13 by a protective flexible strip 18, the strip 18 being adhesively secured to the carrier strip 12 at each side of the groove 13. The optical fibre 14 and the plastics sheathing 16 can both be attacked by the chemical action of the alkaline fluids found in glass fibre reinforced cement. For this reason the strip 18 has at least part of its structure made from a material that acts as an impermeable barrier to those alkaline fluids. The strip 18 can be made from any one of a variety of metals or metal alloys, for example aluminium strip or tape. The pressure from the alkaline fluids and from any particulate material in the block material in the vicinity of the fibre optic element tend to be smoothed out by the flexible strip 18 so that a fairly equal pressure P is exerted along the length of the fibre optic element 14.

The carrier strip 12 has an aspect ratio, that is the ratio of its width W to its thickness T, of greater than 20.

Figure 3:
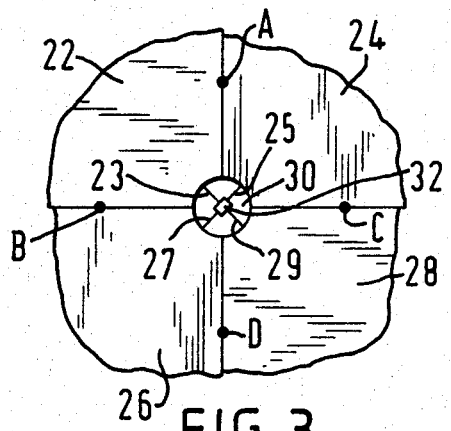
FIG. 3 illustrates how four composite panels of FIG. 1 can be assembled together.

FIG. 3 illustrates how four composite panels 22, 24, 26 and 28, all of which are like that shown in FIG. 1, can be arranged together in juxtaposition. The recessed corners of the panels 22, 24, 26 and 28 together define a cavity 30 in which the ends of the fibre optic elements 23, 25, 27 and 29 are connected together in pairs by a connector 32. The end of fibre optic element 23 is connected to the end of the fibre optic element 29 whilst the end of fibre optic element 27 is connected to the end of fibre optic element 25. In this manner the fibre optic elements 23 and 29 in composite panels 22 and 28 together form a single fibre optic transmission line whilst the fibre optic elements 25 and 27 in composite panels 24 and 26 form another single fibre optic transmission line.

An alternative embodiment is for the ends of the fibre optic elements in each composite panel to emerge at the mid-point of the side faces of the panels, the mid-points of the side faces being formed with or without a recess. In FIG. 3 the mid-points of the side faces of the composite panels are represented by letters A, B, C and D. Thus the ends of a pair of fibre optic elements in adjoining panels 22,24 are joined at point A; the ends of a pair of fibre optic elements in adjoining panels 22, 26 are joined at point B; the ends of a pair of fibre optic elements in adjoining panels 24,28 are joined at point C and the ends of a pair of fibre optic elements in adjoining panels 26,28 are joined at point D.

By arranging the composite panels together in juxtaposition like that illustrated in FIG. 3 it is possible to build up a wall extending along a boundary of an area to be protected. Also one has the facility to build up a security structure partially or completely surrounding a location to be protected. The number and size of the composite panels may vary greatly depending on the size of the area to be protected and on the shape of the security structure required.

For the purpose of illustration FIG. 6 shows how twenty four composite panels, each like that of FIG. 1, can be assembled together to form a cubic housing whose interior represents the protected area in which there could be for example a safe, bank vault, nuclear explosive store, building reactor, or the interior may simply represent a room. The housing has a roof 40, a floor and four side walls, only two of which are shown and designated by numerals 42 and 44 for ease of illustration. The corners of the adjoining panels define the cavities 30 at which the ends of the fibre optic elements are joined together, the dotted lines being representative for illustrative purposes of the typical continuous fibre optic transmission lines that can be formed around the housing. One transmission line is formed by the joining together of a fibre optic element in each of the composite panels 46, 47 and 48 and so on in other panels around the cubic housing returning so as to join up again with the fibre optic element in the composite panel 46. In this way a fibre optic transmission loop is created around the cubic housing. Parts of two other transmission loops are illustrated by the dotted lines passing through composite panels 50, 52, 54 and 56 and through composite panels 58, 60. By this arrangement it is possible to have all the input and output terminals of the security system attached to just one face of the housing, for example face 42.

In FIG. 6 the transmittors and receivers are housed for illustrative purposes in a box 70 and are connected by transmission lines 72, 74 and 76 to terminals in cavities 30 of respective loop transmission lines around the cubic housing.

The security structures made up by the composite panels of FIG. 1 are such that the optic fibre elements are interconnected with optic fibre elements of adjacent panels at the corners. A potential intruder cannot remove, rotate or tilt any panel without breaking an interconnection at a corner of the panel and so creating an alarm signal.

One of the advantages of constructing a security system comprising a number of composite panels as described above is that they can be prefabricated in the factory and installed rapidly around the area to be protected. The composite panels may for example be bolted together and arranged around the area to be protected. Alternatively they may be bolted onto the existing wall or walls or a room or security housing. They could for example be arranged on the inner or outer walls of a bank vault.

It is to be understood that although the composite panels described above are in the form of completely solid blocks many other panel designs can be adopted. For example, it if is desired to install a composite panel or panels over or around the end of a water outflow pipe leading from a nuclear power station then the composite panel or panels can be formed during the moulding process with one or more holes. The water from the outflow pipe can then pass through the holes.

In one embodiment as shown in FIG. 7 the composite panel is in the form of a grid having a number of openings 62 defined between a mesh of composite bars 64. The supporting members and their fibre optic elements are embedded within and pass along the bars 64 in a circuitous route through the ends of each of the fibre optic elements 4, 6 emerging from opposite recessed corners of the block 2.

Figure 9:
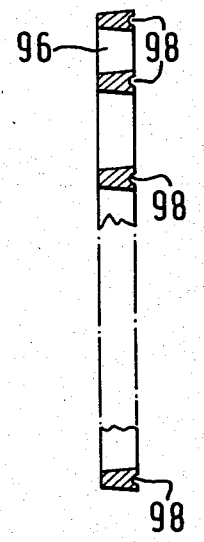
FIG. 9 is a section along line II of FIG. 8
Figure 8:
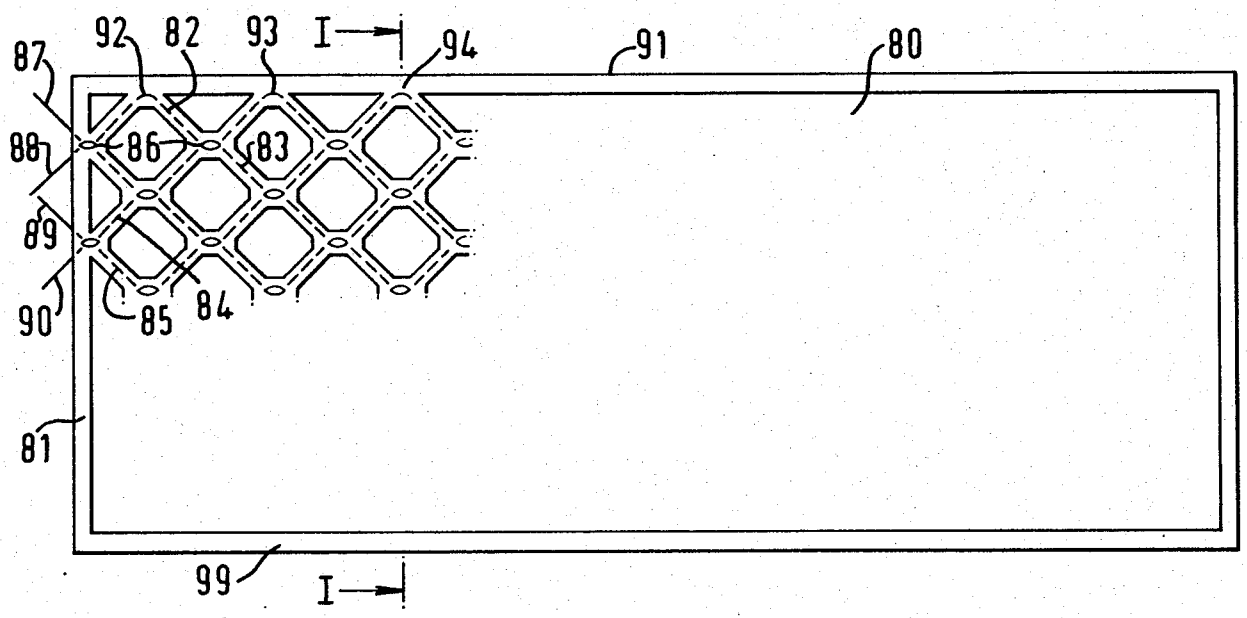
FIG. 8 is a further embodiment of a composite panel.

In FIG. 8 a composite 80 consists of two half sections, the cross-section through one of which is shown in FIG. 9, together sandwiching between them a mesh of fibre optic elements four of which are shown designated 82, 83, 84 and 85. Only a part of the mesh is shown in FIG. 8 and in practice the mesh extends throughout the whole length and width of the panel. The mesh can be in any of the forms described in European Application No. 0049979. In a preferred form the elements 82, 83, 84 and 85 are in the form of optical fibres surrounded by or coated with polyvinylchloride and portions of pairs of the elements 82, 83, 84 and 85 meet at a number of jointing points 86 where they are encapsulated in plastics material. The plastics material secures the portions of the elements at the jointing points 86 in positions fixed relative to one another and adjacent jointing points 86 are spaced apart at distances of 20 cms or less.

Portions of the fibre optic elements 82, 83, 84 and 85 are shown emerging from one side wall 81 of the panel 80 and the emergent portions have been designated 87, 88, 89 and 90 respectively. At the top 91 of the panel the element 82 emerges from the panel in small loops at a number of spaced locations along the length of the panel. Only three of these locations are shown in FIG. 8 and have been designated by numerals 92, 93 and 94. At the bottom 99 of the panel small loops of elements also emerge at a number of spaced locations.

FIG. 9 is a section through one half section 96 of the panel 80 of FIG. 8. Another half section (not shown) identical to half section 96 is also provided. Both are formed with grooves 98 which are arranged in a mesh-like configuration to house the mesh of fibre optic elements. The half sections are bolted together to form the complete panel 80.

Figure 10:
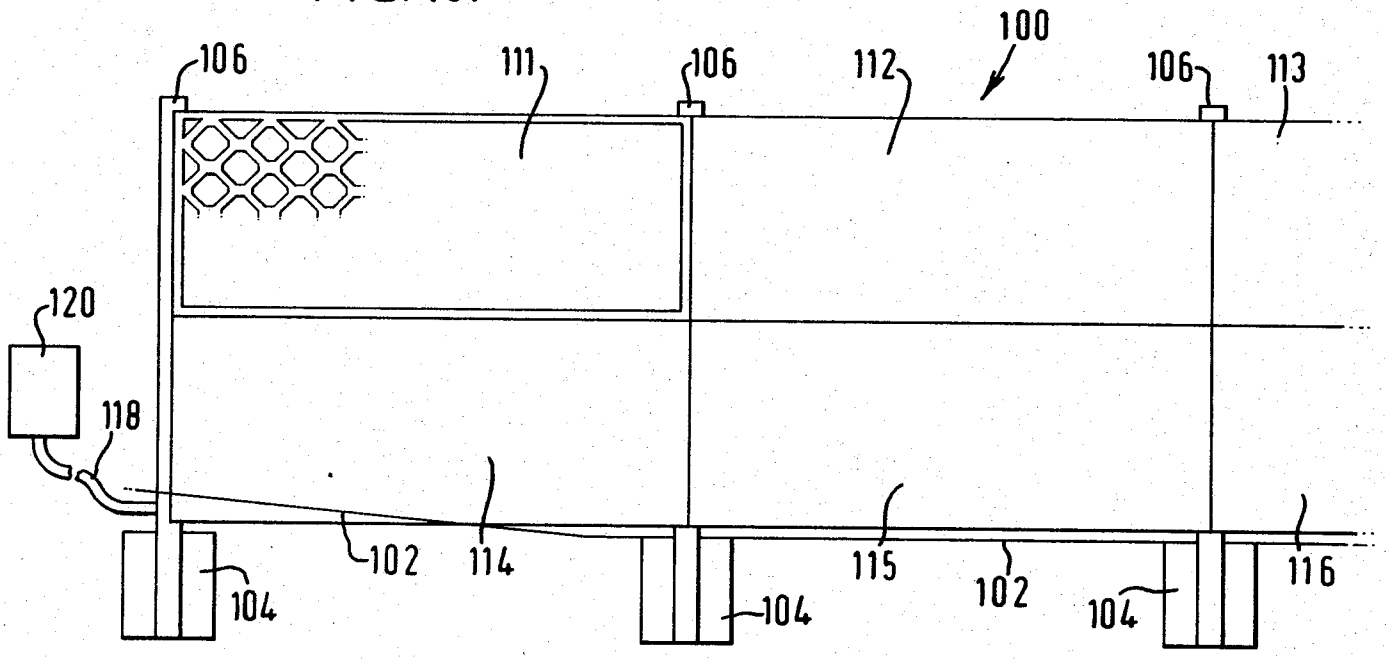
FIG. 10 is a security wall assembled from panels of FIG. 8.

FIG. 10 illustrates a number of composite panels 111, 112, 113, 114, 115 and 116 assembled to form a security wall 100. Only part of the security wall 100 is shown for simplicity of drawing and it extends across a river the bed of which is illustrated by line 102.

At spaced locations within the river bed 102 are formed a number of concrete foundations 104 for supporting concrete posts 106. Between the posts 106 are mounted the composite panels 111, 112, 113, 114, 115 and 116 each of which is like that shown in FIG. 8.

To assemble the wall 100 the posts 106 are first erected in their concrete foundations 104. Half sections of the panels 114, 115 and 116 are then bolted into place between the posts 106. A continuous length of mesh of fibre optic elements like that shown in FIG. 8 is then located in the grooves of the half sections and when in place the remaining half sections of panels 114, 115 and 116 are bolted into place. The composite panels 111, 112 and 113 are similarly assembled with a continuous length of mesh extending through the interior of the panels. The ends of the fibre optic elements which form the mesh emerge at the post 106 shown on the far left of FIG. 10. The elements are attached to fixed connectors which link the elements to other fibre optic elements which are routed through a cable 118 to an electronics unit 120 located in a dry area.

The end portions of the fibre optic elements emerging from panels 111 and 114 and attached to respective connectors in post 106 are of short lengths and each extends in this embodiment less than 20 cms from the nearest jointing point 86. Similarly the continuous lengths of elements emerging from and extending between adjacent pairs of panels, such as panels 111, 112 or panels 112, 113 or panels 114, 115 or panels 115, 116 are also of short lengths, less than 20 cms, from the nearest jointing points 86. If any attempt is made to move adjacent panels relative to one another to a degree so as to provide access through the wall 100 some of the emerging portions are subjected to translatory movement. As the length of emergent portion is short and near a jointing point 86 any extensibility in the length of the emergent portion is quickly taken up and rupture of a fibre optic element occurs.

A number of means are available to increase security even further so as to ensure that relative movement between adjacent panels 111, 114 or panels 112, 115 or panels 113, 116 wil also cause rupture of fibre optic elements. One convenient method is to employ just one large mesh of fibre optic elements whose continuous length extends through all of the panels in the security wall 100. Thus emergent portions of the elements would then also interconnect the panels 111 and 114, 112 and 115, 113 and 116.

Alternatively one can instal a long length of fibre (not shown) through the series of small loops of the elements (see FIG. 8) emerging at the top of panels 114, 115, 116 and also through those emerging from the bottom of panels 111, 112 and 113. In this way as the loops are only small relative movement between for example panels 111 and 114 causes translatory movement of the elements in the loops which due to the proximity of jointing points 86 close to the loops results in rupture of one or more of the elements.

It will be seen that in each of the above described embodiments ends or portions of the fibre optic elements emerge from the panel at spaced locations whose relative positions are such that they do not all lie along a straight line. Translatory movement, rotation or tilting of the panel hence necessarily causes translatory movement of at least one end of at least one of the fibre optic elements. Assuming such movement is large enough, this will cause the fibre optic element to break or otherwise become disconnected from the fibre optic element in the adjacent panel and thereby cause an interruption in the respective fibre optic transmission line. It will be appreciated that the size and geometry of the panels, the spacing of the locations at which the fibre optic elements emerge, and the lengths of the emerging ends or portions of the fibre optic elements are chosen to suit the requirements of the security system in which the panels are employed so that any movement of a panel sufficient to defeat the the particular security required from the system is also sufficient to cause such interruption in a fibre optic transmission line.

We claim:

1. A composite wall panel comprising at least two fibre optic elements rigidly contained within a symmetrical block of material having a regular polygonal panel face comprising parallel edges, bisectors of said edges defining axes of symmetry of said face and fibre optic elements arranged within portions emerging from said blocks at spaced locations whose relative positions are such that when a plurality of said blocks are assembled together to form a security wall or housing having a number of transmission lines comprising said fibre optic elements within the wall or housing, said blocks cannot be moved relative to one another by translatory movement, rotation or tilting so as to provide access through the security wall or housing without also causing translatory movement of at least one emergent portion of one of said fibre optic elements wherein the improvement lies in that each end of one fibre optic element emerges from said block at a respective one of a first pair of spaced locations and each end of a second fibre optic element emerges from said block at a respective one of a second pair of spaced locations, the relative arrangement of the spaced locations being such that there are at least three spaced locations arranged symmetrically about at least one of said axes of symmetry of said panel face and the construction of said block being such that an unlimited number of said blocks can be assembled in juxtaposition to form a wall or housing and any relative movement between said blocks when assembled results in a translatory movement of the emergent portion of at least one of said fibre optic elements ensuring interruption of a transmission line in that wall or housing.

2. A composite panel is claimed in claim 1 in which at at least one of the fibre optic elements follows a circuitous route through the block of material.

3. At least one composite panel (2) as claimed in claim 1 and means for directing optical radiation along the fibre optic elements and detector means to detect optical radiation that has passed through the fibre optic elements, the detector means being responsive to a change in detected radiation.

4. A composite panel as claimed in claim 1 in which the block of material is in the form of a polyhedron having two types of characterizing elements comprising at least four faces and four corners, each end of a first fibre optic element emerging from the block at a respective one of a pair of one type of said characterizing elements of the block, and at least one end of a second fibre optic element emerging from the block at at least a different one of a single type of characterizing element of the block.

5. A composite panel as claimed in claim 4 in which each end of the second fibre optic element emerges from the block at the same type of characterizing element as the ends of the first fibre optic element.

6. A composite panel is claimed in claim 4 in which the ends of the elements emerge at recesses formed in said characterizing elements of the block.

7. A composite panel as claimed in claim 1 in which each fibre optic element is carried on a respective supporting member embedded within the block of material.

8. A composite panel is claimed in claim 7 in which the supporting member for the elements comprises an elongate carrier strip formed with a groove along the centre of one side for receiving a fibre optic element, the fibre optic element being held within the groove by an elongate protective strip overlying the element and the groove.

9. A composite panel as claimed in claim 8 in which the protective strip is impermeable to fluids which can attack the fibre optic element.

10. A composite panel as claimed in claim 8 in which barbs or serrations are provided along the edge or edges of the carrier strip.

11. A composite panel as claimed in claim 8 in which the ratio of the width of the carrier strip to its thickness is more than 10.

12. A composite panel is claimed in claim 8 in which the ratio of the width of the carrier strip to its thickness is more than 20.

13. A composite panel as claimed in claim 1 in which the fibre optic elements are assembled together in the form of a mesh-like structure, the structure having a number of jointing points at which portions of the elements are secured by securing means in a position fixed relative to one another, the portion of an element emerging from the panel being sufficiently close to a jointing point to ensure that translatory movement of the emergent portion leads to rupture of the element and the interruption of one of the transmission lines through the wall or housing.

14. A composite panel as claimed in claim 13 in which the panel is formed from interconnectable sections, the mesh of fibre optic elements being held firmly or loosely in place between the sections.

15. A composite panel as claimed in claim 14 in which at least one of the interconnectable sections is formed with a groove arranged in a mesh-like configuration to house the mesh of fibre optic elements.

16. A method of assembling a wall or housing constructed from a number of composite panels as claimed in claim 14, one section from each of the panels being mounted together in line so as to define a length of the wall or housing, a continuous length of mesh being located on the assembled first sections and the second sections of each of the panels being secured in place over the first sections to enclose the mesh.

17. A security wall or housing constructed from a number of composite panels as claimed in claim 13, at least one mesh of fibre optic elements extending through the wall or housing to define a number of transmission lines.

18. A security system in which a security wall or housing as claimed in claim 17 is provided with means for directing optical radiation along the fibre optic elements, the detector means being responsive to a change in detected radiation.

* * * * *

UNITED STATES PATENT AND TRADEMARK OFFICE

CERTIFICATE OF CORRECTION

PATENT NO. : 4,538,527

DATED : September 3, 1985

INVENTOR(S) : Cedric A. Kitchen

It is certified that error appears in the above-identified patent and that said Letters Patent is hereby corrected as shown below: Title page:

In the Abstract, line 11, delete "mateial" and substitute --material--.

Col. 3, line 19, delete "In" and substitute --If--.

Col. 4, line 35, delete "the" (first occurence).

Col. 4, line 44, delete "of" and substitute --or--.

Col. 5, line 38, after "detect" and before "radiation" insert --optical--

Col. 6, line 14, delete "2" and substitute --12--.

Col. 6, line 17, delete "with" and substitute --within--.

Col. 7, line 58, delete "it if" and substitute --if it--.

Col. 8, line 4, after "composite" insert --panel--.

UNITED STATES PATENT AND TRADEMARK OFFICE

CERTIFICATE OF CORRECTION

PATENT NO. : 4,538,527

DATED : September 3, 1985

INVENTOR(S) : Cedric A. Kitchen

It is certified that error appears in the above-identified patent and that said Letters Patent is hereby corrected as shown below:

Col. 9, line 16, delete "wil" and substitute --will--.

Signed and Sealed this

Tenth Day of January, 1989

*Attest:*

DONALD J. QUIGG

*Attesting Officer*

*Commissioner of Patents and Trademarks*